US009062866B1

(12) United States Patent
Christ et al.

(10) Patent No.: US 9,062,866 B1
(45) Date of Patent: Jun. 23, 2015

(54) ATTACHMENT MECHANISMS FOR LIGHT-EMITTING DIODE-BASED LIGHTING SYSTEM

(71) Applicants: James Richard Christ, Peachtree City, GA (US); Jared Davis, Newnan, GA (US); Jyoti Kathawate, Smyrna, GA (US)

(72) Inventors: James Richard Christ, Peachtree City, GA (US); Jared Davis, Newnan, GA (US); Jyoti Kathawate, Smyrna, GA (US)

(73) Assignee: Cooper Technologies Company, Houston, TX (US)

( * ) Notice: Subject to any disclaimer, the term of this patent is extended or adjusted under 35 U.S.C. 154(b) by 122 days.

(21) Appl. No.: 13/746,649

(22) Filed: Jan. 22, 2013

Related U.S. Application Data

(60) Provisional application No. 61/588,537, filed on Jan. 19, 2012.

(51) Int. Cl.
*F21S 8/02* (2006.01)
*F21V 29/00* (2015.01)
*F21V 21/04* (2006.01)

(52) U.S. Cl.
CPC ..... *F21V 29/004* (2013.01); *F21V 21/04* (2013.01); *F21S 8/026* (2013.01)

(58) Field of Classification Search
CPC ..... F21S 8/02; F21S 8/026; F21V 21/044; F21V 21/04; F21V 21/088
USPC ..... 362/147, 364, 365, 396
See application file for complete search history.

(56) References Cited

U.S. PATENT DOCUMENTS

| | | | | |
|---|---|---|---|---|
| 4,055,874 | A | 11/1977 | Brown | |
| 4,332,060 | A | 6/1982 | Sato | |
| 5,584,575 | A | 12/1996 | Fickel | |
| 5,619,789 | A | 4/1997 | Chung | |
| 5,673,997 | A * | 10/1997 | Akiyama | 362/147 |
| 5,738,436 | A * | 4/1998 | Cummings et al. | 362/294 |
| 5,951,151 | A * | 9/1999 | Doubeck et al. | 362/365 |
| 6,305,829 | B1 | 10/2001 | Thomas et al. | |
| 6,979,107 | B1 | 12/2005 | Benensohn | |
| 7,018,070 | B2 | 3/2006 | McCoy | |
| 7,120,969 | B2 | 10/2006 | Carls | |
| 7,438,433 | B1 | 10/2008 | Steadman et al. | |
| 7,487,584 | B1 | 2/2009 | Lee | |
| 7,959,332 | B2 | 6/2011 | Tickner et al. | |
| 8,070,328 | B1 | 12/2011 | Knoble et al. | |
| 8,096,670 | B2 | 1/2012 | Trott et al. | |
| 8,215,805 | B2 | 7/2012 | Cogliano et al. | |
| 8,220,970 | B1 | 7/2012 | Khazi et al. | |
| 8,348,477 | B2 | 1/2013 | Tickner et al. | |
| 8,405,947 | B1 | 3/2013 | Green et al. | |
| 8,445,144 | B2 | 5/2013 | Utsugi et al. | |
| 8,491,166 | B2 * | 7/2013 | Thompson, III | 362/373 |

(Continued)

*Primary Examiner* — Peggy Neils
(74) *Attorney, Agent, or Firm* — King & Spalding LLP

(57) ABSTRACT

A light emitting diode (LED) lighting system includes an enclosure, a trim, and at least one attachment mechanism. The enclosure can include at least one heat-generating device and an enclosure collar, where the enclosure is made of a first thermally conductive material. The trim can include a trim collar and at least one wall that defines a passage, where the trim collar abuts the enclosure collar, and where the passage has a reflector and a LED is disposed therein. The least one attachment mechanism can removably couple the trim collar to the enclosure collar, where the at least one attachment mechanism includes a back plate that is mechanically coupled to an upper flange and a lower flange, where the upper flange contacts the enclosure collar and the lower flange contacts the trim collar.

20 Claims, 8 Drawing Sheets

(56) References Cited

U.S. PATENT DOCUMENTS

| | | | | |
|---|---|---|---|---|
| 8,500,305 | B2 | 8/2013 | O'Sullivan et al. | |
| 8,602,601 | B2 | 12/2013 | Khazi et al. | |
| 8,845,144 | B1 | 9/2014 | Davis et al. | |
| 2005/0265016 | A1 * | 12/2005 | Rappaport | 362/147 |
| 2007/0147052 | A1 | 6/2007 | Wyatt | |
| 2009/0086476 | A1 | 4/2009 | Tickner et al. | |
| 2010/0085759 | A1 | 4/2010 | O'Sullivan et al. | |
| 2010/0110699 | A1 * | 5/2010 | Chou | 362/365 |
| 2010/0246193 | A1 | 9/2010 | Clifton et al. | |

* cited by examiner

ATTACHMENT MECHANISMS FOR LIGHT-EMITTING DIODE-BASED LIGHTING SYSTEM

CROSS-REFERENCE TO RELATED APPLICATIONS

This application claims priority under 35 U.S.C. §119 to U.S. Provisional Patent Application Ser. No. 61/588,537, titled "LED-Based Lighting System" and filed on Jan. 19, 2012, the entire contents of which are hereby incorporated herein by reference.

The present application is also related to a patent application titled "Light-Emitting Diode Driver Case," having U.S. patent application Ser. No. 13/463,107 and filed on May 3, 2012, the entire contents of which are hereby incorporated herein by reference.

The present application is also related to a patent application titled "Reflectors and Reflector Orientation Feature to Prevent Non-Qualified Trim," having U.S. patent application Ser. No. 13/465,779 and filed on May 7, 2012, the entire contents of which are hereby incorporated herein by reference.

The present application is further related to U.S. patent application Ser. No. 13/746,817, titled "Secondary Enclosure for Light-Emitting Diode-Based Lighting System," which is being filed concurrently with the U.S. Patent and Trademark Office.

The present application is further related to U.S. patent application Ser. No. 13/746,835 titled "Optical Attachment Features for Light-Emitting Diode-Based Lighting System," which is being filed concurrently with the U.S. Patent and Trademark Office.

TECHNICAL FIELD

The present disclosure relates generally to an enclosure for a light-emitting diode (LED) fixture, and more particularly, to attachment mechanisms for a LED fixture.

BACKGROUND

Recessed lighting is used in a number of different applications. In a number of cases, recessed lighting uses LED technology to provide one or more of a number of benefits, including but not limited to decreased energy consumption, reduced maintenance, and increased efficacy. As with most lighting technologies, LED lighting systems can generate heat energy that needs to be dissipated from certain components (e.g., the LED, the control board, the LED driver) of the LED lighting system so that those components can operate more efficiently and last longer. LED technologies used with recessed lighting involve relatively confined spaces, and the dissipation of heat energy becomes more important.

SUMMARY

In general, in one aspect, the disclosure relates to a LED lighting system. The LED lighting system can include an enclosure having at least one heat-generating device and an enclosure collar, where the enclosure is made of a first thermally conductive material. The LED lighting system can also include a trim having a trim collar and at least one wall that defines a passage, where the trim collar abuts the enclosure collar, and where a reflector and a LED are disposed within the passage. The LED lighting system can further at least one attachment mechanism that removably couples the trim collar to the enclosure collar, where the at least one attachment mechanism includes a back plate that is mechanically coupled to an upper flange and a lower flange, where the upper flange contacts the enclosure collar and the lower flange contacts the trim collar when the enclosure is mechanically coupled to the trim.

In another aspect, the disclosure can generally relate to a LED lighting system. The LED lighting system can include an enclosure having at least one heat-generating component and an enclosure collar, where the enclosure is made of a first thermally conductive material, and where the enclosure collar comprises a first coupling feature. The LED lighting system can also include a trim having a trim collar and at least one wall that defines a passage, where the trim collar includes a second coupling feature, and where the passage has a reflector disposed therein. The first coupling feature and the second coupling feature can detachably couple to each other.

These and other aspects, objects, features, and embodiments will be apparent from the following description and the appended claims.

BRIEF DESCRIPTION OF THE DRAWINGS

The drawings illustrate only example embodiments of attachment mechanisms for LED-based lighting systems and are therefore not to be considered limiting of its scope, as the attachment mechanisms for LED systems may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
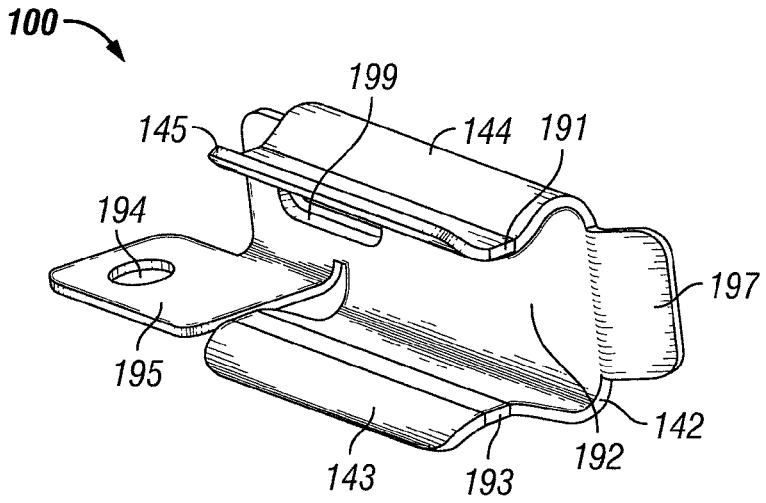
FIG. 1 shows a perspective view of an attachment mechanism for a LED-based lighting system in accordance with one or more example embodiments.

Example embodiments of attachment mechanisms for LED systems will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments herein may be practiced without these specific details. In other instances, well-known features have not been described in detail to avoid unnecessarily complicating the description. As used herein, a length, a width, and height can each generally be described as lateral directions.

While the example embodiments described herein are directed to LED lighting systems, example attachment mechanisms can also be used for other types of lighting systems (e.g., fluorescent lighting systems, organic LED lighting systems) and/or with other types of enclosures not related to lighting systems. Therefore, example attachment mechanisms described herein should not be considered limited to LED lighting systems.

Example attachment mechanisms described herein are directed to mechanically attaching an enclosure to a trim for a lighting system, such as a LED-based lighting system. In such a lighting system, one or more components (e.g., LED driver, LEDs) within and/or mechanically coupled to the enclosure (described below with respect to FIGS. 2A and 2B) generate heat energy. The enclosure can be made of one or more of a number of thermally conductive materials and can act, at least in part, as a heat sink. As a result, the enclosure absorbs some of the heat energy generated by the heat-generating components.

Because some LED-based lighting systems are installed in spatially restrictive spaces (e.g., in a junction box, in a down can), the dissipation of heat absorbed by the enclosure is important to maintain the operating efficiency of the LED-based lighting fixture and to sustain the useful life of the various components (e.g., LED, LED driver) of the LED-based lighting fixture. Thus, efficiently coupling the trim to the enclosure can utilize the trim as an additional heat sink by absorbing some of the heat absorbed by the enclosure.

The example attachment mechanisms can be applied and/or removed without the use of tools. Thus, example attachment mechanisms described herein allow a user to easily, without tools, change a trim, access one or more portions of the LED-based lighting system, perform maintenance, perform a retrofit, and/or perform some other task with respect to the LED-based lighting system.

Several important factors may be considered when coupling the enclosure and the trim. For example, providing good thermal communication between the enclosure and the trim can be important to efficiently transfer heat absorbed by the enclosure to the trim for heat dissipation. As another example, the integrity and stability of the LED-based lighting system is improved when the trim is solidly coupled to the enclosure. As another example, the ease of operating the attachment mechanism used to couple the trim and the enclosure can be increased when no tools are required. As described herein, in addition to coupling the trim and the enclosure, attachment mechanisms may also (or in the alternative) couple the trim and/or the enclosure to another component of the LED-based lighting system, including but not limited to the LED driver.

In certain applications, the example attachment mechanisms are subject to one or more of a number of standards and/or regulatory requirements. For example, Underwriter's Laboratories (UL) publishes and maintains standard 1598, which applies to luminaires for use in non-hazardous locations with voltage of 600V nominal or less. Such standards and/or regulatory requirements can be applicable to one or more of a number of countries, including but not limited to the United States, Canada, and Mexico.

FIG. 1 shows a perspective view of an attachment mechanism for a LED-based lighting system in accordance with one or more example embodiments. In one or more embodiments, one or more of the features shown in FIG. 1 may be omitted, repeated, and/or substituted. Accordingly, embodiments of attachment mechanisms for LED-based lighting systems should not be considered limited to the specific arrangements of components shown in FIG. 1.

Referring now to FIG. 1, the attachment mechanism 100 in this example is a type of clip having a lower flange 193 that is connected to a back plate 192 by a lower hinge 142, as well as an upper flange 191 that is connected to the back plate 192 by an upper hinge 144. The lower flange 193 and the upper flange 191 can each extend at any angle from the back plate 192. Such an angle can be any angle, including but not limited to an acute angle, an obtuse angle, and an angle of approximately 90°. Such an angle for the lower flange 193 can put the lower flange 193 on a substantially parallel plane with the lower surface of the trim collar, against which the lower flange 193 contacts when the attachment mechanism 100 is engaged with the trim. Similarly, the angle for the upper flange 191 can put the upper flange 191 on a substantially parallel plane with the upper surface of the enclosure collar, against which the upper flange 191 contacts when the attachment mechanism 100 is engaged with the enclosure.

The upper hinge 144 and/or the lower hinge 142 can have any shape (e.g., semi-circular, squared) and/or dimensions. The upper hinge 144 and the lower hinge 142 can apply a compressive force to the upper flange 191 and the lower flange 193, respectively, that is transferred to the enclosure collar and the trim collar, respectively. This compressive force keeps the enclosure and the trim mechanically coupled to each other when the attachment mechanism 100 is positioned over the enclosure collar and the trim collar. In other words, the upper hinge 144 and the lower hinge 142 each cause an inward force to be applied by the upper flange 191 against the enclosure collar and by the lower flange 193 against the trim collar. Similarly, when the compressive force applied by the upper hinge 144 and the lower hinge 142 is overcome, the upper flange and the lower flange can be removed from the enclosure collar and the trim collar.

In certain example embodiments, when the attachment mechanism 100 is mechanically coupled to an enclosure and a trim, the lower flange 193 contacts the trim, and the upper flange 191 contacts the enclosure. The dimensions (e.g., length, width) of the upper flange 191 and the lower flange 193 can be any dimensions to allow the attachment mechanism 100 to secure the enclosure and the trim together while also being removable by a user. Similarly, the lower flange 193 and upper flange 191 can each have a distal end that includes one or more features that help secure the trim to the enclosure, while also allowing a user to remove the attachment mechanism 100 without the use of tools. For example, as shown, the distal end of the lower flange 193 and the upper flange 191 can be tapered. Specifically, the tapered distal end 145 of the upper flange 191 curves upward, away from the enclosure collar. Likewise, the tapered distal end 143 of the lower flange 193 curves downward, away from the trim collar.

In certain example embodiments, as shown in FIG. 1, the attachment mechanism 100 can also include a support plate 195. The support plate 195 can extend substantially perpendicularly (also called a right angle) from the back plate 192 and/or be on a substantially level plane with the lower flange 193. Alternatively, the support plate 195 can extend from the back plate 192 at an acute angle or at an obtuse angle. The support plate 195 can have little or no tapered edge or support hinge 148, and so all or substantially all of its length couples to the trim (or the enclosure when the attachment mechanism 100 is installed in a reverse orientation from that described above) when used to couple the enclosure and the trim. The support hinge 148 can be used to mechanically couple the support plate 195 to the back plate 192. The support hinge 148 can be the same size as, smaller than, or larger than the hinge 142 that mechanically couples the lower flange 193 to the back plate 192.

The support plate 195 can have an aperture 194 that traverses therethrough. In such a case, the aperture 194 can have a shape and size sufficient to receive a fastening device (described below with respect to FIGS. 2A and 2B), such as a rivet or screw. In certain example embodiments, the lower flange 193 may be replaced by the support plate 195. Alternatively, in lieu of a support plate 195, the aperture 194 can traverse the lower flange 193. In certain example embodiments, there may be no aperture 194 in the support plate 195 or the lower flange 193.

Optionally, in certain example embodiments, the attachment mechanism 100 can also include one or more return flanges 197. A return flange 197 can allow a user to more easily secure the attachment mechanism 100 so that the attachment mechanism 100 can be moved (e.g., slidably, rotatably) when the attachment mechanism 100 is mechanically coupled to an enclosure and a trim. As shown in FIG. 1, each return flange 197 can extend at an acute angle (e.g., 10°, 30°) or some other angle from a side of the back plate 192. In addition, or in the alternative, the tapered distal end 145 of the upper flange 191 and/or the tapered distal end 143 of the lower flange 193 can be, or can include, a return flange 197.

Optionally, the back plate 192 can include one or more features that add stiffness or otherwise improve the clamping performance of the attachment mechanism 100 when the attachment mechanism 100 is mechanically coupled to the enclosure and the trim. For example, as shown in FIG. 1, the back plate 192 can include a stamped portion 199. The stamped portion 199 can be an outward-directed stamp (as shown in FIG. 1) or an inward-directed stamp. The stamped portion 199 can have any thickness, width, height, or other features to improve the stiffness of the attachment mechanism 100. The stamped portion 199 can be positioned at any location on the back plate 192. For example, as shown in FIG. 1, the stamped portion 192 can be positioned adjacent to the support plate 195. There can be more than one stamped portion 192 on the back plate 192. In addition, or in the alternative, any other feature (e.g., upper flange 191, support plate 195) of the attachment mechanism 100 can have one or more stamped portions.

The attachment mechanism 100 can be made of one or more of a number of materials (e.g., metal, plastic) that are rigid with some flexibility. The attachment mechanism 100 can be formed from a single piece of material (as from a casting process, a stamping process, a forging process, some other suitable process, or any combination thereof). Alternatively, the attachment mechanism 100 can be made of two or more pieces that are mechanically coupled to each other using one or more coupling mechanisms, including but not limited to welding, fusing, snap fittings, and fastening devices (e.g., nuts and bolts, rivets).

Figure 2A:
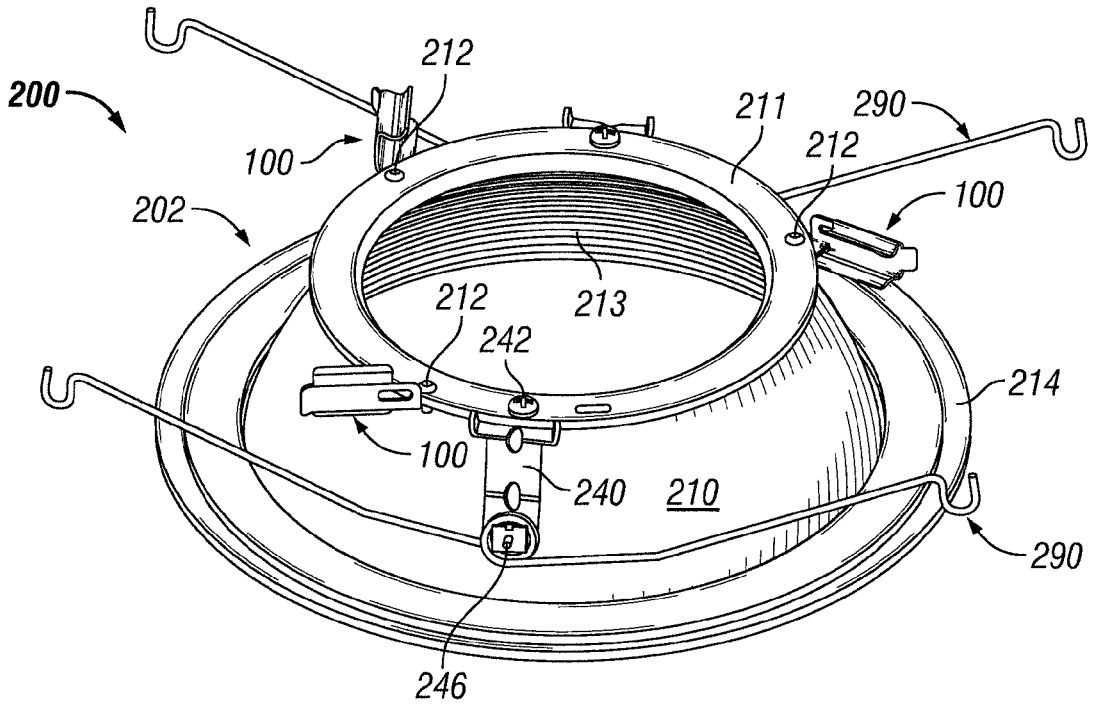
FIGS. 2A and 2B each show perspective views of a LED-based lighting system using the attachment mechanism of FIG. 1 in accordance with one or more example embodiments.
Figure 2B:
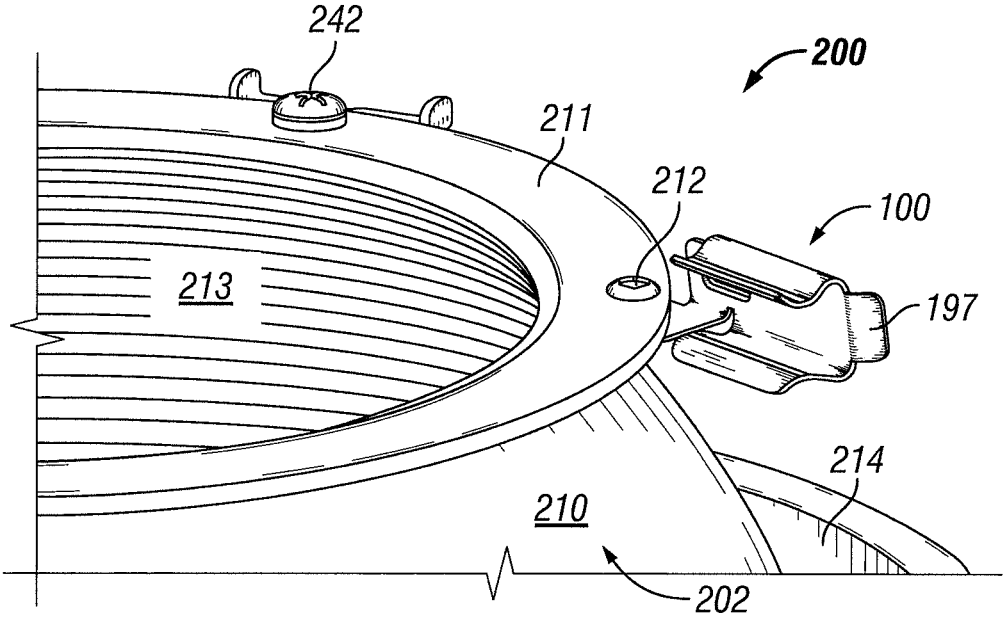

FIGS. 2A and 2B each show perspective views of a portion of a LED-based lighting system 200 using the attachment mechanism 100 of FIG. 1 in accordance with one or more example embodiments. Specifically, FIGS. 2A and 2B show the attachment mechanism 100 hingedly coupled to the trim collar 211 of a trim 202. Referring to FIGS. 1-2B, the attachment mechanism 100 is hingedly coupled to the trim collar 211 of the trim 202 using a fastening device 212 (e.g., a rivet, a screw, a bolt, a pin) that is fixedly fastened above the top surface of the trim collar 211 and also below the bottom surface of the support plate 195 of the attachment mechanism 100. The fastening device 212 traverses the aperture 194 in the support plate 195 as well as an aperture (not shown) that traverses the trim collar 211.

The fastening device 212 allows the attachment mechanism 100 to hingedly rotate with respect to the trim collar 211. The length of the fastening device 212 may be such that the support plate is always in contact with the bottom surface of the trim collar 211, regardless of the position of the attachment mechanism 100 with respect to the trim collar 211. In this case, the return flange 197 is positioned at the end of the back plate 192 opposite from where the support plate 195 is positioned. This allows a user to rotate the attachment mechanism 100 about the fastening device 212 by applying a lateral force to the return flange 197. In such an example, the fastening device 212 can allow the attachment mechanism 300 to be hingedly coupled to the trim and removably coupled to the enclosure.

As shown in FIGS. 2A and 2B, there can be multiple fastening devices 212, one for each attachment mechanism 100. In such a case, the multiple attachment mechanisms 100 can be spaced substantially equidistant from each other or at some other varying distance from each other. When there are multiple attachment mechanisms 100, each fastening device 212 can be positioned in the same relative position and/or in a different relative position with respect to the attachment mechanism 100. For example, if there are two attachment mechanisms 100, one fastening device 212 may be positioned in such a way to require the attachment mechanism 100 to rotate counter-clockwise to decouple the upper flange 191 and the lower flange 193 from the enclosure collar and the trim collar 211, while the other fastening device 212 may be positioned in such a way to require the other attachment mechanism 100 to rotate clockwise to decouple the upper flange 191 and the lower flange 193 from the enclosure collar and the trim collar 211.

The trim 202 can have one or more of a number of other features that do not directly impact the example fastening devices 100 described herein. For example, as shown in FIGS. 2A and 2B, the trim 202 can include one or more torsion springs 290. The torsion spring 290 and/or other mounting feature (e.g., friction clip mounting post (not shown)) can be used to secure the LED-based lighting system 200 to a housing (e.g., junction box, downlight can) (not shown) inside of which the LED-based lighting system 200 is mounted. When torsion springs 290 are used for mounting, the torsion springs 290 can be mechanically coupled to the trim 202 (and/or another portion, such as the enclosure, of the LED-based lighting fixture 200) in one or more of a number of ways. In this example, the torsion springs 290 are affixed to the outer surface of the trim body 210 using a clip 240 that is mechanically coupled to the under side of the trim collar 211 using a fastening device 242 (e.g., a screw, a bolt, a rivet).

The trim 202 can also include other features, such as a baffle 213 along the inner wall and a base 214 that extends away from the trim body 210 at the bottom end. In some example embodiments, the base 214 is substantially parallel to the trim collar 211. The baffle 213 (inner wall) of the trim 202, bounded by the trim collar 211 at the top end of the trim 202 and by the base 214 at the bottom end of the trim 202, defines a passage 219 that houses one or more of a number of components of the LED-based lighting system. Such components can include, but are not limited to, a reflector, a lens, one or more LEDs, a diffuser, and an optical feature.

The top surface of the trim collar 211 includes one or more features that complement features on the bottom surface of the enclosure collar (not shown). For example, as shown in FIGS. 2A and 2B, if the top surface of the trim collar 211 is relatively flat and smooth, the bottom surface of the enclosure collar may also be relatively flat and smooth. In addition, the plane in which a portion of the top surface of the trim collar 211 traverses can be substantially parallel to the plane in which a corresponding portion of the bottom surface of the enclosure collar traverses. As another example, if there are features (e.g., portions of a fastening device 242) that protrude in one of the collars, the other collar can have a corresponding recess to accommodate the protrusion.

While the trim collar 211 shown in FIGS. 2A and 2B is located at the top end of the trim 202, the trim collar 211 can be located at any other location on the trim 202. The trim collar 211 can be located on the exterior and/or the interior of the trim 202. In any event, the trim collar 211 is positioned in a location on the trim 202 that is accessible to the enclosure collar so that the trim collar 211 and the enclosure collar can mate and be mechanically coupled to each other by the attachment mechanism 100.

Figure 3:
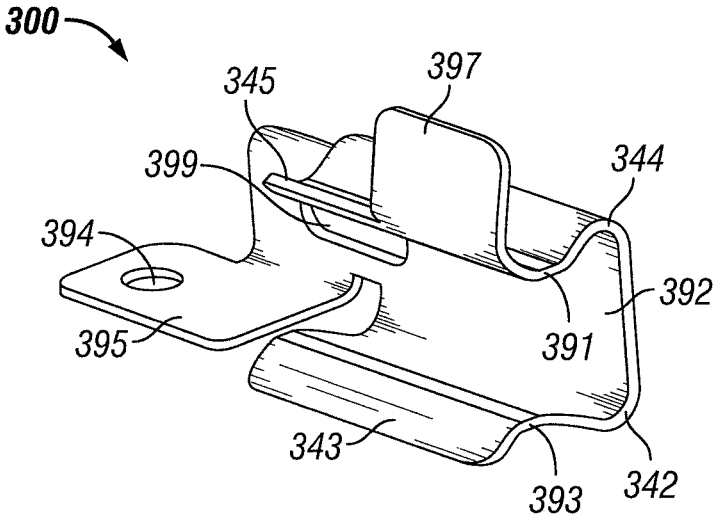
FIG. 3 shows a perspective view an alternative attachment mechanism for a LED-based lighting system in accordance with one or more example embodiments.

FIG. 3 shows a perspective view an alternative attachment mechanism 300 for a LED-based lighting system in accordance with one or more example embodiments. The attachment mechanism 300 is substantially similar to the attachment mechanism 100 described above with respect to FIG. 1, except as described below. In one or more embodiments, one or more of the features shown in FIG. 3 may be omitted, repeated, and/or substituted. Accordingly, embodiments of attachment mechanisms for LED-based lighting systems should not be considered limited to the specific arrangements of components shown in FIG. 3.

Referring now to FIG. 3, instead of being positioned on a side of the back plate 392, the return flange 397 is an extension of part of the tapered distal end 345 of the upper flange 391. In addition, the length of the upper flange 391 and the lower flange 393 may be a bit shorter than the corresponding length of the upper flange 191 and the lower flange 193 of the attachment mechanism 100 of FIG. 1. This difference may be attributable to a shallower enclosure collar and/or trim collar of the LED-based lighting system for which the attachment mechanism 300 is used.

Figure 4A:
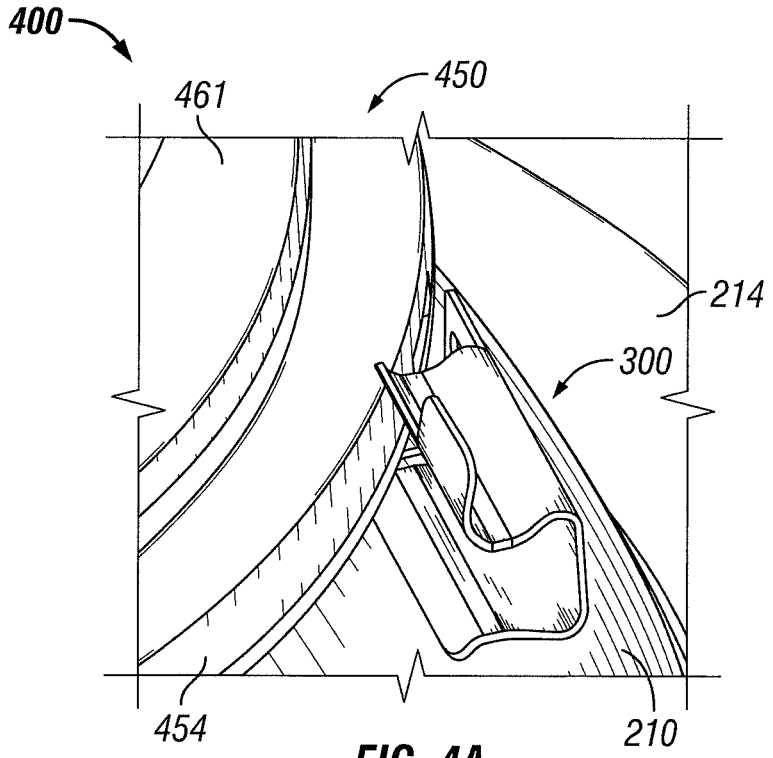
FIGS. 4A and 4B show various views of a LED-based lighting system using the attachment mechanism of FIG. 3 in accordance with one or more example embodiments.
Figure 4B:
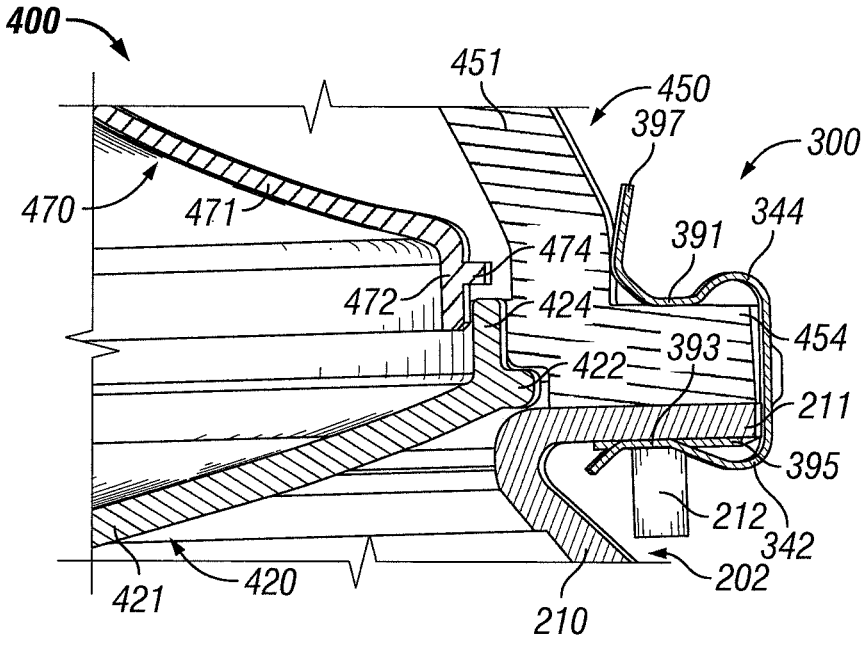

FIGS. 4A and 4B show various views of a LED-based lighting system 400 using the attachment mechanism 300 of FIG. 3 in accordance with one or more example embodiments. Specifically, FIG. 4A shows a top perspective view of the LED-based lighting system 400 using the attachment mechanism 300. FIG. 4B shows a cross-sectional side view of the LED-based lighting system 400 using the attachment mechanism 300. In one or more embodiments, one or more of the features shown in FIGS. 4A and 4B may be omitted, repeated, and/or substituted. Accordingly, embodiments of LED-based lighting systems using attachment mechanisms should not be considered limited to the specific arrangements of components shown in FIGS. 4A and 4B. The LED-based lighting system 400 is substantially similar to the LED-based lighting system 200 described above with respect to FIGS. 2A and 2B, except as described below.

Referring to FIGS. 1-4B, the attachment mechanism 300 is rotatably coupled to the trim collar 411 of the trim 202 using the fastening device 212 that is fixedly fastened above the top surface of the trim collar 211 and also below the bottom surface of the support plate 395 of the attachment mechanism 300. The fastening device 212 traverses the aperture in the support plate 395 as well as an aperture (not shown) that traverses the trim collar 211. The fastening device 212 allows the attachment mechanism 300 to hingedly rotate with respect to the trim collar 211.

In addition, or in the alternative, the fastening device 212 (or a separate fastening device 212) can extend above the top surface of the enclosure collar 454. In such a case, an aperture in the upper flange 391 and/or a support plate can receive such a fastening device 212 in a substantially similar way described above with respect to the fastening device 212 that extends from the lower surface of the trim collar 211. For example, a fastening device 212 can be fixedly coupled to the enclosure collar 454 and traverse an aperture in a support plate (either the support plate 395 or a different support plate) of the attachment mechanism 300. In either case, the support plate can be mechanically coupled to the back plate and positioned adjacent to the upper flange 391. In such an example, the fastening device 212 can allow the attachment mechanism 300 to be hingedly coupled to the enclosure and removably coupled to the trim.

As another example, the fastening device 212 can be mechanically coupled to one of the trim collar 211 or the enclosure collar 454, and traverse an aperture in the other of the enclosure collar 454 or the trim collar 211. In such a case, the attachment mechanism 300 can have multiple support plates 395 with apertures through which the fastening device 212 can traverse, one positioned adjacent to the upper flange 391 and one positioned to the lower flange 393. In such a case, one of the support plates 395, the upper flange 391, and/or the lower flange 393 can be sized and/or shaped in such a say as to allow the enclosure 450 to physically separate from the trim 202 when the fastening mechanism 300 is rotated to a certain position. In the absence of a support plate 395, the upper flange 391 and/or the lower flange 393 can have an aperture through which the fastening device 212 can traverse.

FIG. 4B also shows detail as to the enclosure 450, the reflector 470, and the diffuser 420. The enclosure 450 has an enclosure wall 451 and has a lower cavity 459 into which the reflector 470 and the diffuser 420 are positioned. Along the inner surface of the enclosure wall 451, at the enclosure collar 454, is a recess 455 that is sized to receive a radially outward protrusion 422 from the diffuser collar 424 along the outer perimeter of the diffuser body 421. In certain example embodiments, the reflector 470 is positioned atop the diffuser collar 424. For example, as shown in FIG. 4B, the outer edge of the reflector body 471 includes a reflector collar 472, which extends downward away from the reflector body 471. An outward protrusion 474 can extend radially away from the reflector collar 472 in such a way that the protrusion 474 can be positioned atop the end of the diffuser collar 424, and the outer surface of the reflector collar 472 is adjacent to the inner surface of the diffuser collar 424. The reflector 470 can be any type of optical device used to direct light emitted by the LEDs.

More details about the enclosure 450 are described in U.S. patent application Ser. No. 13/746,817, titled "Secondary Enclosure for Light-Emitting Diode-Based Lighting System," which is being filed concurrently with the U.S. Patent and Trademark Office, the entire contents of which are hereby incorporated by reference. In addition, more details of the reflector 470 and the diffuser 420 are described in U.S. patent application Ser. No. 13/746,835, titled "Optical Attachment Features for Light-Emitting Diode-Based Lighting System," which is being filed concurrently with the U.S. Patent and Trademark Office, the entire contents of which are hereby incorporated by reference.

While the enclosure collar 454 shown in FIGS. 4A and 4B is located at the bottom end of the enclosure 450, the enclosure collar 454 can be located at any other location on the enclosure 450. The enclosure collar 454 can be located on the exterior and/or the interior of the enclosure. In any event, the enclosure collar 454 is positioned in a location on the enclosure 450 that is accessible to the enclosure collar so that the trim collar 211 and the enclosure collar 454 can mate and be mechanically coupled to each other by the attachment mechanism 300.

Figure 5:
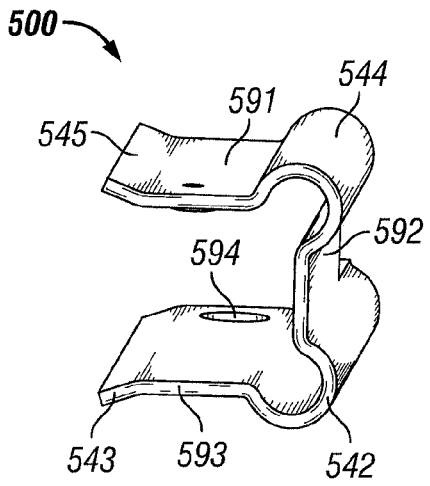
FIG. 5 shows a perspective view of yet another attachment mechanism for a LED-based lighting system in accordance with one or more example embodiments.

FIG. 5 shows a perspective view of yet another attachment mechanism 500 for a LED-based lighting system in accordance with one or more example embodiments. The attachment mechanism 500 is substantially similar to the attachment mechanisms 100 and 300 described above with respect to FIGS. 1 and 3, respectively, except as described below. In one or more embodiments, one or more of the features shown in FIG. 5 may be omitted, repeated, and/or substituted. Accordingly, embodiments of attachment mechanisms for LED-based lighting systems should not be considered limited to the specific arrangements of components shown in FIG. 5.

Referring now to FIG. 5, the attachment mechanism 500 does not have a support plate. Instead, the aperture 594 is disposed on, and traverses, the lower flange 593. In addition, the attachment mechanism 500 does not have any return flanges. Aside from the aperture 594 in the lower flange 593, the upper portion of the attachment mechanism 500 is substantially symmetrical to the lower portion of the attachment mechanism 500.

Figure 6:
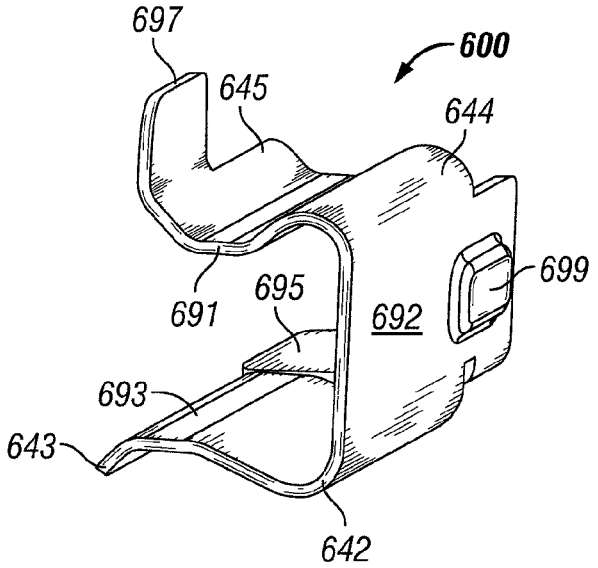
FIG. 6 shows a perspective view of yet another attachment mechanism for a LED-based lighting system in accordance with one or more example embodiments.

FIG. 6 shows a perspective view of still another attachment mechanism 600 for a LED-based lighting system in accordance with one or more example embodiments. The attachment mechanism 600 is substantially similar to the attachment mechanism 300 described above with respect to FIG. 3, except that the width of each of the components (e.g., upper flange 691, support plate 695, back plate 692) of the attachment mechanism 600 are shorter than the corresponding components of the attachment mechanism 300.

Figure 7:
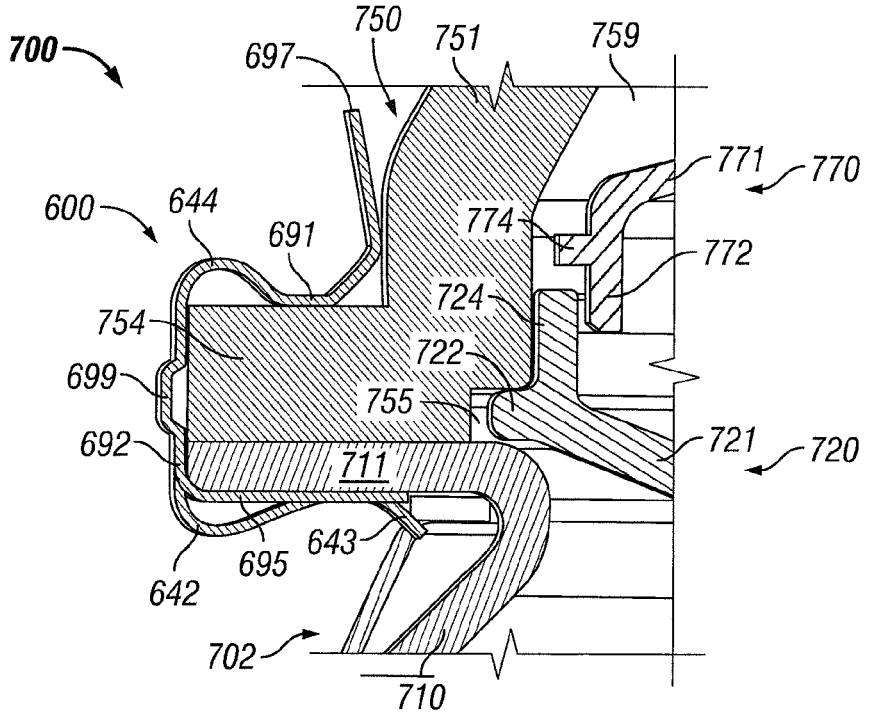
FIG. 7 shows a cross-sectional side view of a LED-based lighting system using the attachment mechanism of FIG. 6 in accordance with one or more example embodiments.

FIG. 7 shows a cross-sectional side view of the LED-based lighting system 700 using the attachment mechanism 600 of FIG. 6 in accordance with certain example embodiments. One or more of the features shown in FIG. 7 may be omitted, repeated, and/or substituted. Accordingly, embodiments of LED-based lighting systems using attachment mechanisms should not be considered limited to the specific arrangements of components shown in FIG. 7. The LED-based lighting system 700 is substantially similar to the LED-based lighting system 400 described above with respect to FIGS. 4A and 4B, except as described below.

Even though there may be an aperture through the support plate 695, there is no fastening device that traverses such an aperture. In other words, the attachment mechanism 600 is not hingedly coupled to the trim collar 711 or the enclosure collar 754. As a result, the attachment mechanism 600 is detachably coupled to both the trim collar 711 and the enclosure collar 754. The return flange 697, which extends from away from a portion of the tapered distal end 645 of the upper flange 691, can be used to pry the upper flange 691 away from the enclosure collar 754, reducing or eliminating the inward force applied by the upper flange 691 against the enclosure collar 754.

The features of the enclosure 750, trim 702, reflector 770, and diffuser 720 are substantially similar to the corresponding components described above with respect to FIG. 4B. For example, the recess 755 along the inner surface of the enclosure wall 751 near the enclosure collar 754, as well as the radially outward protrusion 722 from the diffuser collar 724 along the outer perimeter of the diffuser body 721, are substantially similar to the recess 455 and protrusion 455 of FIG. 4B. As another example, the configuration and positioning of the outward protrusion 774 from the reflector collar 772 relative to the diffuser collar 724 are substantially similar to the configuration and positioning of the corresponding portions of the reflector 470 and diffuser 420 of FIG. 4B.

FIGS. 8A-12 show various example embodiments of an attachment mechanism in which the enclosure and the trim can be detachably coupled to each other. The enclosure can be coupled to the trim in one or more of a number of ways using a variety of attachment mechanisms. For example, in the LED-based lighting system 800 of FIGS. 8A and 8B, the trim 802 includes a trim collar 815 that is used in coupling the trim 802 to the enclosure 850. In this case, the trim collar 815 includes a number of tabs 817 (a type of coupling feature of the attachment mechanism) that protrude horizontally from the vertical trim collar 815. The number of tabs 817 corresponds to a number of slots 855 (a type of complementary coupling feature of the attachment mechanism) that each run along a horizontal portion of the enclosure collar 854. When the tabs 817 align with the slots 855, the trim 802 may be rotated relative to the enclosure 850 (in this case, rotating the enclosure 850 clockwise and/or rotating the trim 802 counterclockwise) until the tabs 817 reach the end of the slots 855. The tabs 817 and/or the slots 855 can include one or more features (e.g., detents, protrusions, recesses) that allow the tabs 817 to lock into place when the tabs 817 reach the end of the slots 855.

In certain example embodiments, the slots 855 and the tabs 817 are aligned substantially equidistant from each other and each have substantially identical dimensions. In such a case, the orientation of the trim 802 relative to the enclosure 850 is not relevant. Alternatively, one of the slots 855 and tabs 817 may have different dimensions from the other slots 855 and tabs 817 and/or the slots 855 and tabs 817 may be spaced non-equidistantly. In such a case, the orientation of the trim 802 relative to the enclosure 850 must be specific for the trim 802 to couple to the enclosure 850. In this example, the LED driver 840 is disposed on top of (or at some other location outside of), rather than inside of, the enclosure 850.

Figure 8A:
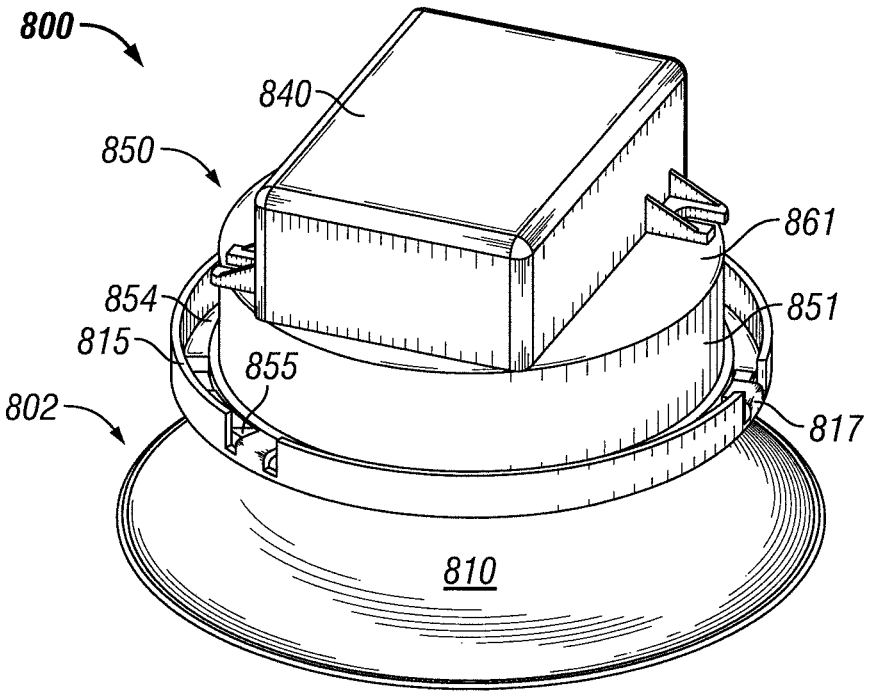
FIGS. 8A and 8B show various views of a LED-based lighting system that includes another alternative attachment mechanism in accordance with one or more example embodiments.
Figure 8B:
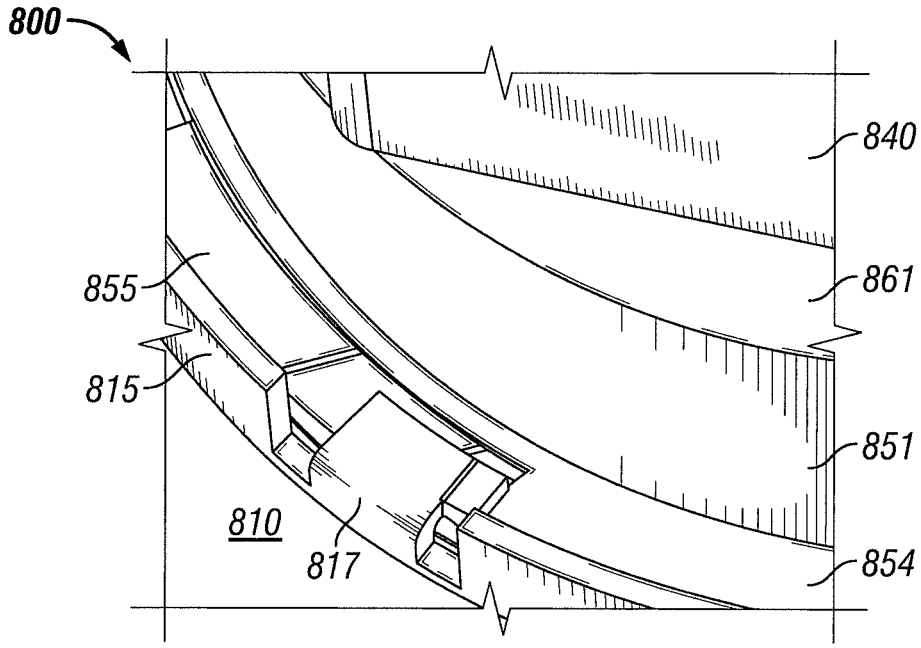
Figure 9:
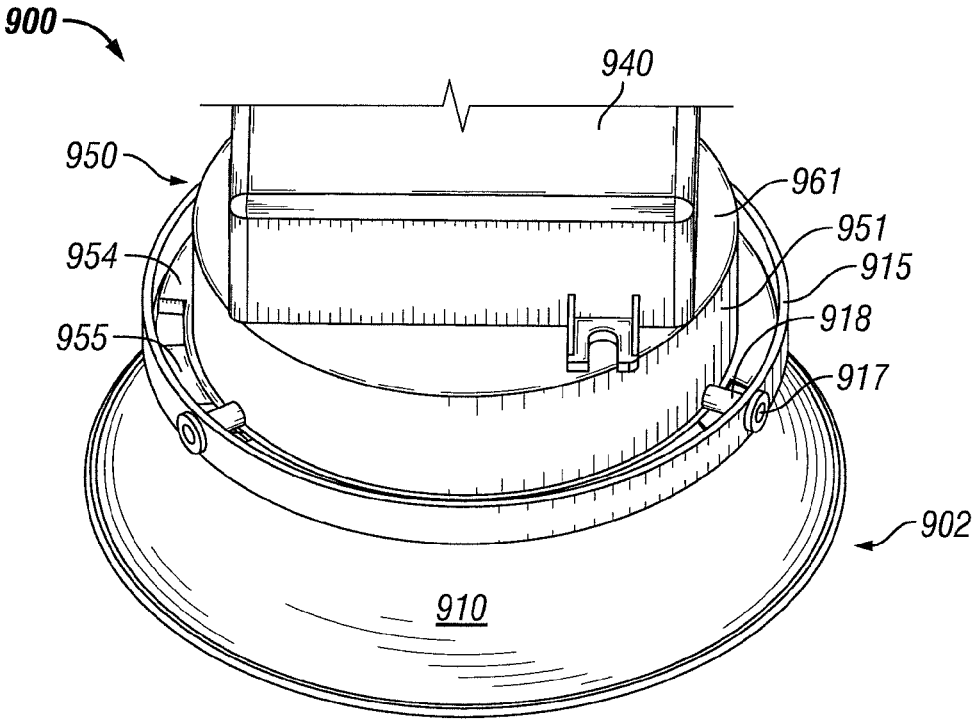
FIG. 9 shows a perspective view of a LED-based lighting system that includes another alternative attachment mechanism in accordance with one or more example embodiments.

As another example of an attachment mechanism, FIG. 9 shows a different LED-based lighting system 900 using alternative coupling features relative to that shown in FIGS. 8A and 8B and to the various attachment mechanisms of FIGS. 1-7. Specifically, the trim collar 915 now includes a number of posts 918 (a type of coupling feature of the attachment mechanism) rather than a number of tabs 817 and the slots 855 of FIGS. 8A and 8B. The posts 918 may be coupled to the trim collar 915 in one or more of a number of ways, including but not limited to welding, threaded couplings, and threaded fasteners.

In this case, the slots 955 (a type of complementary coupling feature of the attachment mechanism) in the enclosure collar 954 of the enclosure 950 couple with the posts 918 and allow the posts 918 to slide along the slots 955. When the posts 918 align with the slots 955, the trim 902 may be rotated relative to the enclosure 950 (in this case, rotating the enclosure 950 clockwise and/or rotating the trim 902 counter-clockwise) until the posts 918 reach the end of the slots 955 and lock into place. In this example, the LED driver 940 is disposed on top of (or at some other location outside of), rather than inside of, the enclosure 950.

Figure 10:
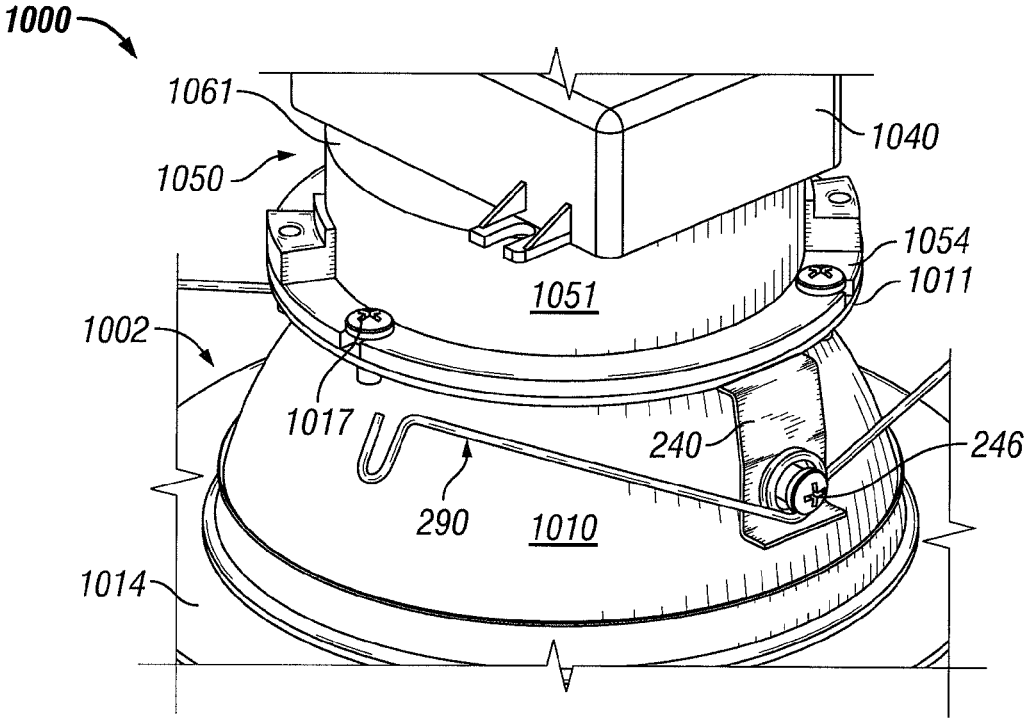
FIG. 10 shows a perspective side view of a LED-based lighting system that includes yet another alternative attachment mechanism in accordance with one or more example embodiments.

As yet another example of an attachment mechanism, FIG. 10 shows a LED-based lighting system 1000 using other alternative coupling features. Specifically, the trim collar 1011 and the enclosure collar 1054 include a number of apertures (a type of coupling feature of the attachment mechanism) that correspond to (align with) each other. In such a case, the enclosure 1050 and the trim 1002 couple to each other when the apertures of the trim collar 1011 and the enclosure collar 1054 are aligned and a fastening device 1017 (a complementary type of coupling feature of the attachment mechanism) traverses such apertures. The fastening device 1017 may be any device suitable for securing the enclosure 1050 to the trim 1002, including but not limited to threaded screws and a nut/bolt combination. In this example, the LED driver 1040 is disposed on top of (or at some other location outside of), rather than inside of, the enclosure 1050.

Figure 11:
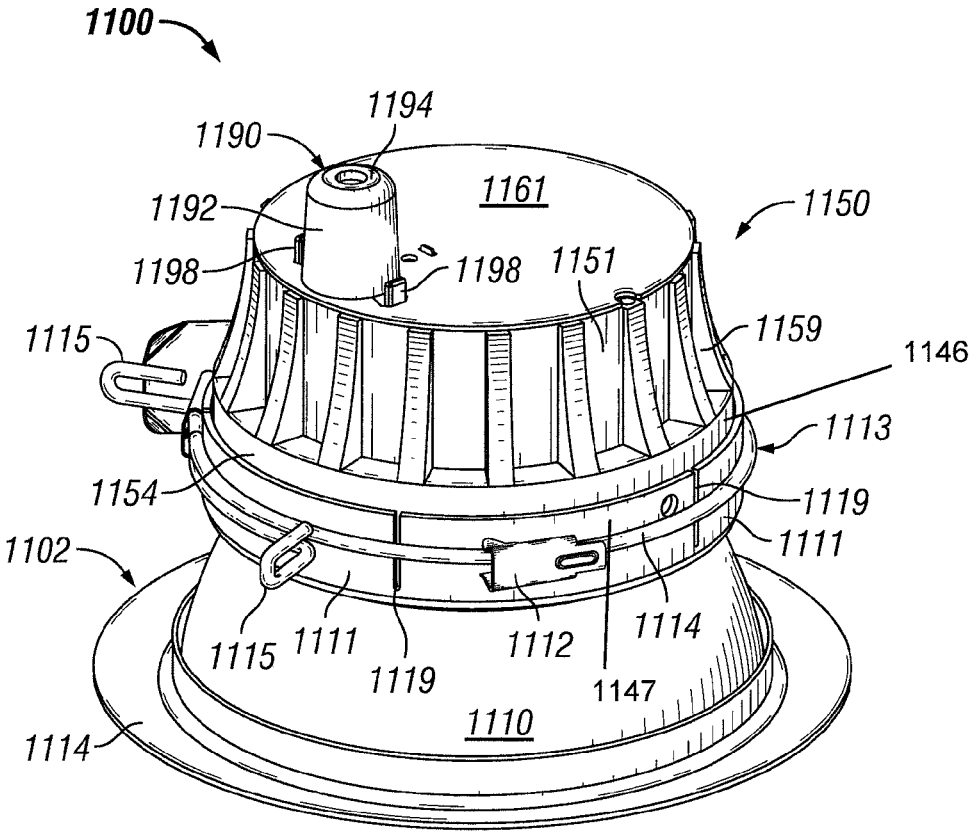
FIG. 11 shows a perspective side view of a LED-based lighting system that includes still another alternative attachment mechanism in accordance with one or more example embodiments.

As still another example of an attachment mechanism, FIG. 11 shows a LED-based lighting system 1000 using yet other alternative coupling features. Specifically, the trim collar 1111 of the trim 1102 includes a number of vertical slots 1119 that extend to the top edge of the trim collar 1111, dividing the trim collar 111 into panel segments 1147 (a type of coupling feature of the attachment mechanism). The vertical slots 1199 between the collapsible panel segments 1147 are designed to allow the top edge of the trim collar 1111 to pinch inward (collapsible collar) when exposed to an inward-directed force. In this case, the inward force on the trim collar 1111 is applied by a pinch spring 1113 (a type of complementary coupling feature of the attachment mechanism).

The pinch spring 1113 can be properly aligned and held in place along the trim collar 1111 using one or more collar guides 1112 that are coupled to the trim collar 1111 and allow the pinch spring 1113 to pass therethrough. In such a case, the enclosure collar 1154 of the enclosure 1150 and the trim collar 1111 couple to each other when the pinch spring 1113 is in a natural state. The enclosure collar 1154 can be a substantially vertical and have one or more of a number of features to help maintain contact with the trim collar 1111 when the pinch spring 1113 is in the natural state. For example, some or all of the enclosure collar 1154 can have a textured outer surface 1146. To remove the inward force applied by the pinch spring 1113 (to put the pinch spring 1113 in an unnatural state), the handles 1115 of the pinch spring 1113 can be moved toward each other. Because the pinch spring 1113 applies a compressive force, when no force is applied to the handles 1115, the pinch spring 1113 is in a natural state.

The enclosure 1150 in this example has a number of protrusions 1159 (e.g., fins) along the outer surface of the enclosure wall 1151. In addition, a secondary enclosure 1190, which houses a wire splice, is mechanically coupled to the top plate 1161 of the enclosure 1150. The secondary enclosure 1190 includes a top surface 1194, a wall 1192, and a pair of clips 1198 that protrude through apertures in the top plate 1161 and allow the secondary enclosure 1190 to mechanically couple to the enclosure 1150. Further, the LED driver (not shown) can be positioned inside of the enclosure 1150 or at a location remote from the enclosure 1150.

Figure 12:
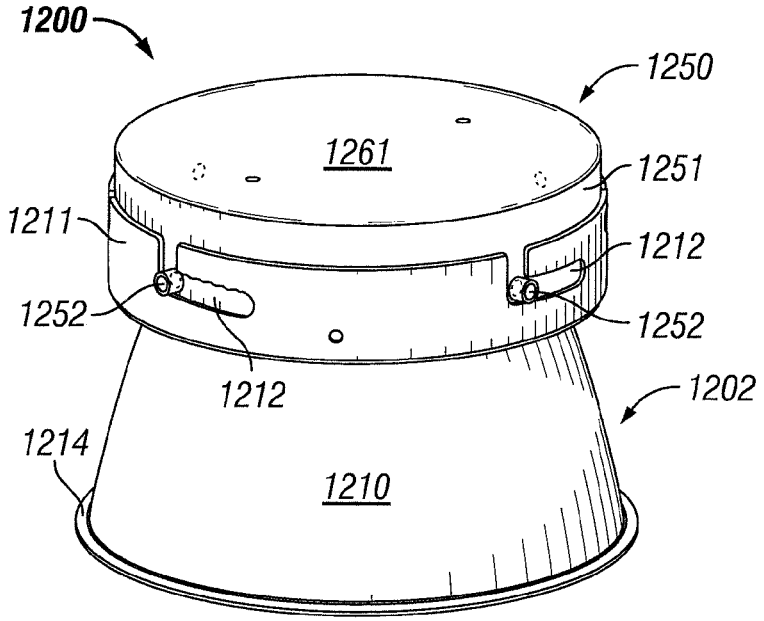
FIG. 12 shows a perspective side view of a LED-based lighting system that includes yet another alternative attachment mechanism in accordance with one or more example embodiments.

As still another example of an attachment mechanism, FIG. 12 shows a system 1200 using still other alternative coupling features. Specifically, the trim collar 1211 includes a number of L-shaped locking slots 1212 that extend to the top edge of the trim collar 1211. The enclosure 1250 has a corresponding number of posts or locking pins 1252 protruding therefrom. In this case, the locking slots 1212 of the trim collar 1211 are configured to couple with the locking pins 1252 and allow the locking pins 1252 to slide into, down, and then along the locking slots 1211. When the locking pins 1252 align with the locking slots 1211 and the enclosure 1250 and trim 1202 are pushed toward each other, the trim 1202 may be rotated relative to the enclosure 1250 (in this case, rotating the enclosure 1250 clockwise and/or rotating the trim 1202 counter-clockwise) until the locking pins 1252 reach the end of the locking slots 1212 and lock into place.

Figure 13A:
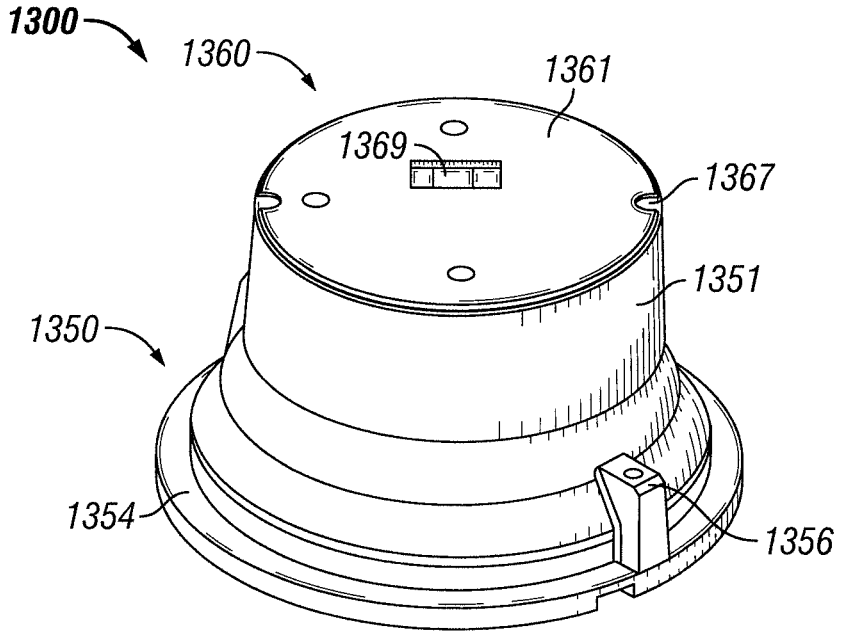
FIGS. 13A and 13B show various views of an enclosure of a LED-based lighting system that uses an attachment mechanism in accordance with one or more example embodiments.
Figure 13B:
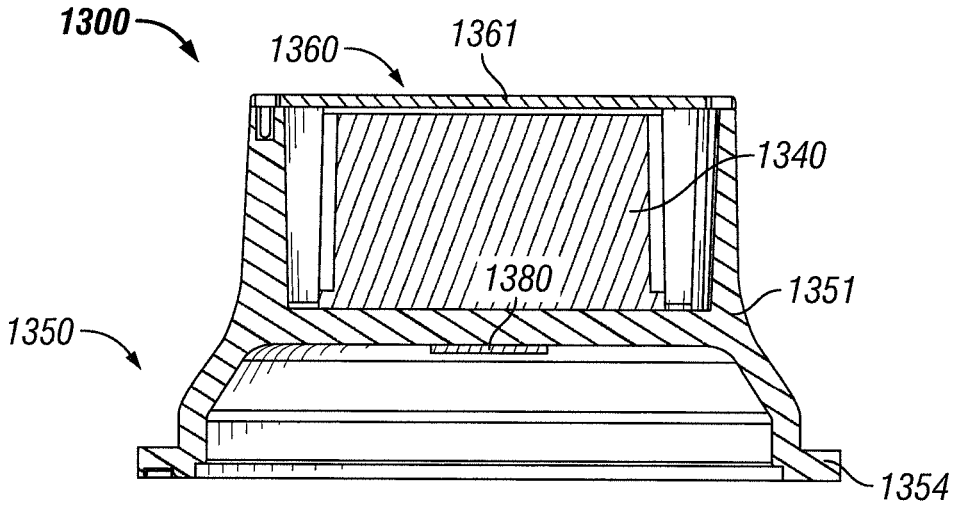

FIGS. 13A and 13B show various views of an enclosure 1350 of a LED-based lighting system 1300 that uses an attachment mechanism in accordance with one or more example embodiments. Specifically, FIG. 13A shows a perspective view of the enclosure 1350, and FIG. 13B shows a cross-sectional side view of the enclosure 1350. In one or more embodiments, one or more of the features shown in FIGS. 13A and 13B may be omitted, repeated, and/or substituted. Accordingly, embodiments of enclosures for a LED-based lighting system should not be considered limited to the specific arrangements of components shown in FIGS. 13A and 13B.

Referring to FIGS. 13A and 13B, the enclosure wall 1351 of the enclosure 1350 has a smooth outer surface. In other words, the profile of the enclosure 1350 is minimized. Such a lack of features (e.g., protrusions, fins) is atypical of a device acting as a heat sink, because the greater the surface area of the heat sink, the more effective the dissipation of heat absorbed by the heat sink. However, as the features of the heat sink get more complex, the cost to manufacture and maintain increase. Having a smooth outer surface, as with the enclosure wall 1351 in this example, simplifies the design and manufacture of the enclosure 1350, reduces the cost to produce and maintain the enclosure 1350, and eases installation and maintenance of the LED-based lighting system 1300.

The need for increased surface area of the enclosure wall 1351 is reduced or eliminated because of the effective transfer of heat from the enclosure 1350 to the trim using the example attachment mechanisms described herein. In this case, the enclosure 1350 has a LED driver 1340 disposed in an upper cavity, and LEDs 1380 disposed in a lower cavity. Both the LED driver 1340 and the LEDs 1380 are heat-generating components. Thus, the enclosure wall 1351 of the enclosure 1350 absorb heat generated by the LED driver 1340 and the LEDs 1380. When the example attachment mechanisms couple the enclosure collar 1354 to the trim collar (not shown), the heat absorbed by the enclosure 1350 from the heat-generating devices (e.g., LED driver 1340, LEDs 1380) is dissipated, at least in part, from the enclosure 1350 to the trim because of the mechanical coupling of the enclosure 1350 and the trim using the example attachment mechanisms.

The top plate 1361 of the enclosure 1350 shows an aperture 1369 through which a wire, luminaire disconnect, and/or wire splice can traverse. A secondary enclosure, such as the secondary enclosure 1190 of FIG. 11, can be used to enclose the wire, luminaire disconnect, and/or wire splice. Further, the enclosure 1350 can include a friction clip mounting post 1356 and/or some other feature that allows the enclosure 1350 to mechanically couple to an enclosure (e.g., a downlight can, a junction box).

The systems, methods, and apparatuses described herein allow for LED-based lighting systems to be installed in new and/or exiting enclosures with little or no extra space. Specifically, example attachment mechanisms allow for the efficient transfer of heat absorbed by the enclosure to the trim, which is exposed to the ambient environment. Further, example attachment mechanisms allow for simplified design of the enclosure, which reduces costs, saves time and material, and eases installation and maintenance.

Because the example attachment mechanisms are detachable from the enclosure and/or the trim, accessing components inside of the enclosure and/or trim is made simpler and requires no tools. These benefits save time and money, and increase the ease of maintenance and installation. In addition, changing trims for decorative or other aesthetic purposes becomes simple and time saving. Further, because certain example embodiments have the attachment mechanism be hingedly coupled to the enclosure or the trim, there is a greatly reduced chance of dropping, misplacing, or destroying the example attachment mechanisms.

Example embodiments of LED-based lighting systems described herein allow for relatively inexpensive modules that are easy to install. Further, example embodiments of LED-based lighting systems effectively reduce materials and parts required, as well as associated costs. Example embodiments of LED-based lighting systems also provide for aesthetically attractive fixtures that may be unique or that mimic an existing non-LED lighting system currently known in the art. In addition, example embodiments may be used in one or more of a number of types of installation for the lighting fixture, including but not limited to installations requiring torsion springs and installations requiring friction clips (and a corresponding friction clip mounting post).

Further, the example LED-based lighting systems described herein are thermally managed to meet lifetime and/or light output requirements. In addition, LED-based lighting systems allow for improved optical cutoff, reduced glare, and uniform illumination (i.e., no or minimal "dead zones," "cave effect," and/or light output fluctuations). Further, example embodiments of LED-based lighting systems allow for easier installation, maintenance, and disassembly. In addition, because of the use of LEDs, less energy may be consumed using example embodiments of LED-based lighting systems.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

We claim:

1. A light-emitting diode (LED) lighting system, comprising:

an enclosure comprising at least one heat-generating device and an enclosure collar, wherein the enclosure is made of a first thermally conductive material;

a trim comprising a trim collar and at least one wall that defines a passage, wherein the trim collar abuts the enclosure collar, and wherein a reflector and a LED are disposed within the passage; and at least one attachment mechanism that removably couples the trim collar to the enclosure collar, wherein the at least one attachment mechanism comprises a back plate that is mechanically coupled to an upper flange and a lower flange, wherein the upper flange contacts the enclosure collar and the lower flange contacts the trim collar when the enclosure is mechanically coupled to the trim, wherein the at least one attachment mechanism further comprises an upper hinge and a lower hinge, wherein the upper hinge couples the upper flange to the back plate, and wherein the lower hinge couples the lower flange to the back plate.

2. The LED lighting system of claim 1, further comprising:

a fastening device that is fixedly coupled to the enclosure collar and that traverses an aperture in a support plate of the at least one attachment mechanism, wherein the support plate is mechanically coupled to the back plate and is positioned adjacent to the upper flange of the at least one attachment mechanism, wherein the fastening device allows the at least one attachment mechanism to be hingedly coupled to the enclosure and removably coupled to the trim.

3. The LED lighting system of claim 1, further comprising:

a fastening device that is fixedly coupled to the trim collar and that traverses an aperture in a support plate of the at least one attachment mechanism, wherein the support plate is mechanically coupled to the back plate and is positioned adjacent to the lower flange of the at least one attachment mechanism, wherein the fastening device allows the at least one attachment mechanism to be hingedly coupled to the trim and removably coupled to the enclosure.

4. The LED lighting system of claim 3, wherein the support plate is mechanically coupled to the back plate.

5. The LED lighting system of claim 3, wherein the back plate comprises a stamped portion that is positioned adjacent to the support plate.

6. The LED lighting system of claim 3, wherein the support plate is mechanically coupled to the back plate using a support hinge.

7. The LED lighting system of claim 1, wherein the at least one attachment mechanism further comprises at least one return flange.

8. The LED lighting system of claim 7, wherein the at least one return flange extends at an acute angle from a side of the back plate.

9. The LED lighting system of claim 7, wherein the at least one return flange extends from a distal end of the upper flange.

10. The LED lighting system of claim 1, wherein the upper flange creates an angle with the back plate such that the upper flange is substantially parallel with an upper surface of the enclosure trim when the at least one attachment mechanism is mechanically coupled to the enclosure.

11. The LED lighting system of claim 1, wherein the upper hinge and the lower hinge apply a compressive force that, when overcome, allows the upper flange and the lower flange to be removed from the enclosure collar and the trim collar, and wherein the upper hinge and the lower hinge, when the compressive force is not overcome, cause the upper flange and the lower flange to apply an inward force against the enclosure collar and the trim collar.

12. The LED lighting system of claim 1, wherein the at least one attachment mechanism is formed from a single piece of material.

13. The LED lighting system of claim 1, wherein the lower flange comprises a distal end that angles away from the trim flange when the at least one attachment mechanism is mechanically coupled to the trim.

14. A light-emitting diode (LED) lighting system, comprising:

an enclosure comprising at least one heat-generating component and an enclosure collar, wherein the enclosure is made of a first thermally conductive material, and wherein the enclosure collar comprises a first coupling feature disposed on a side enclosure surface, wherein the side enclosure surface is adjacent to a bottom enclosure surface; and a trim comprising a trim collar and at least one wall that defines a passage, wherein the trim collar comprises a second coupling feature disposed on a side trim surface, wherein the side enclosure surface is adjacent to a bottom enclosure surface, and wherein the passage has a reflector disposed therein, and wherein the first coupling feature and the second coupling feature detachably couple to each other.

15. The LED lighting system of claim 14, wherein the first coupling feature comprises a tab, and wherein the second coupling feature comprises a slot that slidably receives the tab.

16. The LED lighting system of claim 14, wherein the first coupling feature comprises an aperture, and wherein the second coupling feature comprises a post that slidably traverses the aperture.

17. The LED lighting system of claim 14, wherein the first coupling feature comprises a locking pin, and wherein the second coupling feature comprises a locking slot that slidably receives the locking pin.

18. The LED lighting system of claim 14, wherein the first coupling feature comprises a textured outer surface, and wherein the second coupling feature comprises a pinch spring, at least one guide, and a plurality of collapsible panel segments.

19. The LED lighting system of claim 1, wherein the at least one heat-generating component comprises at least one selected from a group consisting of the LED and a LED driver.

20. The LED lighting system of claim 1, wherein the reflector is disposed along an inner wall of the trim.

* * * * *